United States Patent [19]

Ruschmann

[11] Patent Number: 4,952,436

[45] Date of Patent: Aug. 28, 1990

[54] ADORNMENT OF FABRIC

[76] Inventor: Roberta Ruschmann, P.O. Box 360, Meadowbrook Farm, Bernardsville, N.J. 07924

[21] Appl. No.: 434,509

[22] Filed: Nov. 14, 1989

Related U.S. Application Data

[63] Continuation of Ser. No. 26,831, Mar. 17, 1987, abandoned.

[51] Int. Cl.[5] ..... B32B 3/02

[52] U.S. Cl. ..... 428/65; 428/52; 428/98

[58] Field of Search ..... 428/52, 65, 54, 64, 428/98

[56] References Cited

U.S. PATENT DOCUMENTS

| | | | |
|---|---|---|---|
| D. 205,392 | 7/1966 | Mifsud . | |
| D. 205,619 | 8/1966 | Williams . | |
| D. 218,689 | 9/1970 | Johnson, Jr. . | |
| D. 256,681 | 9/1980 | Green . | |
| 558,186 | 4/1986 | Kursheedt . | |
| 583,490 | 6/1897 | Kursheedt | 428/52 |
| 1,026,131 | 5/1912 | Taylor . | |
| 1,243,709 | 10/1917 | Cavanaugh | 428/52 |
| 2,256,645 | 3/1941 | Kuhlman | 41/34 |
| 2,362,596 | 11/1944 | Trattler | 41/10 |
| 2,656,541 | 10/1953 | Beaver et al. . | |
| 2,935,434 | 5/1960 | Dawson . | |
| 3,142,088 | 7/1964 | Cravath . | |
| 3,154,036 | 10/1964 | Fimmel . | |
| 3,416,196 | 12/1968 | Mathison . | |
| 3,552,057 | 1/1971 | de Perthus de Laillevault . | |
| 3,932,247 | 1/1976 | Oshima . | |
| 4,071,387 | 1/1978 | Schlaepfer . | |
| 4,251,311 | 2/1981 | Lemelson . | |
| 4,415,623 | 11/1983 | Schlaepfer . | |
| 4,459,706 | 7/1984 | Smith et al. . | |

FOREIGN PATENT DOCUMENTS

| | | | |
|---|---|---|---|
| A2146521 | 3/1973 | France . | |
| A2226832 | 11/1974 | France . | |
| 6509807 | 1/1967 | Netherlands | 428/52 |
| A643377 | 9/1950 | United Kingdom . | |

*Primary Examiner*—Alexander S. Thomas

*Attorney, Agent, or Firm*—Kane, Dalsimer, Sullivan, Kurucz, Levy, Eisele and Richard

[57] ABSTRACT

An adornment for affixing to fabric comprised of several ornaments in a series. The ornaments are attached by threads. The adornment is affixed by either a heat sealable thread which binds the adornment to the fabric upon application of sufficient heat and pressure, or by a heat sealable coating or 2 heat sealable material laminated on the individual ornaments.

26 Claims, 3 Drawing Sheets

ADORNMENT OF FABRIC

This is a continuation of co-pending application Ser. No. 26,831 filed on Mar. 17, 1987 now abandoned.

FIELD OF THE INVENTION

The invention relates to adornments for fabrics and more particularly to composite ornaments for affixing to fabric.

BACKGROUND OF THE INVENTION

The affixing of ornaments such as beads and sequins to fabric is a time-consuming, labor intensive operation in the garment industry. Originally each individual ornament was hand sewn. At present strings of ornaments are available having threads which run the length of the underside of the string. These strings present a considerable cost saving in that they permit the sewer to quickly attach a large number of ornaments. However, the strings must still be sewn by hand.

In addition, when strings of ornaments are sewn on by hand in a fixed shape, constant attention must be given to its shape. This also represents considerable labor costs.

The present invention is an improved method for affixing adornments to fabric that alleviates the high labor cost of hand sewing, and allows strings of ornaments to be used as a separate unit with a rigidity of their own.

SUMMARY OF THE INVENTION

The primary object of the invention is to provide an adornment for fabric which can be quickly and easily attached to fabric which is neither labor intensive nor requires expensive equipment.

Another object of the invention is to provide a method of affixing an adornment to a fabric which involves placing a string of ornaments on a fabric. The string of ornaments contains at least one heat softenable thread. Upon application of heat and pressure to the adornment and fabric, the heat softenable thread melts and binds the string of ornaments to the fabric.

An additional object of the present invention is to provide a string of ornaments which can be quickly and easily attached to a fabric.

A further object of the present invention is to provide a string of ornaments with sufficient rigidity such that it may be shaped as a separate unit and retain its shape while being affixed to the substrate.

These and various other features of novelty which characterize the invention are pointed out with particularity in the claims annexed hereto and forming a part hereof. However, for a better understanding of the invention, reference should be had to the drawings which form a further part hereof, and to the accompanying descriptive matter, in which there is illustrated and described a preferred embodiment of the invention.

BRIEF DESCRIPTION OF THE DRAWINGS

In the drawings in which like reference numerals and letters indicate corresponding parts throughout the several views.

DESCRIPTION OF THE PREFERRED EMBODIMENT

Figure 1:
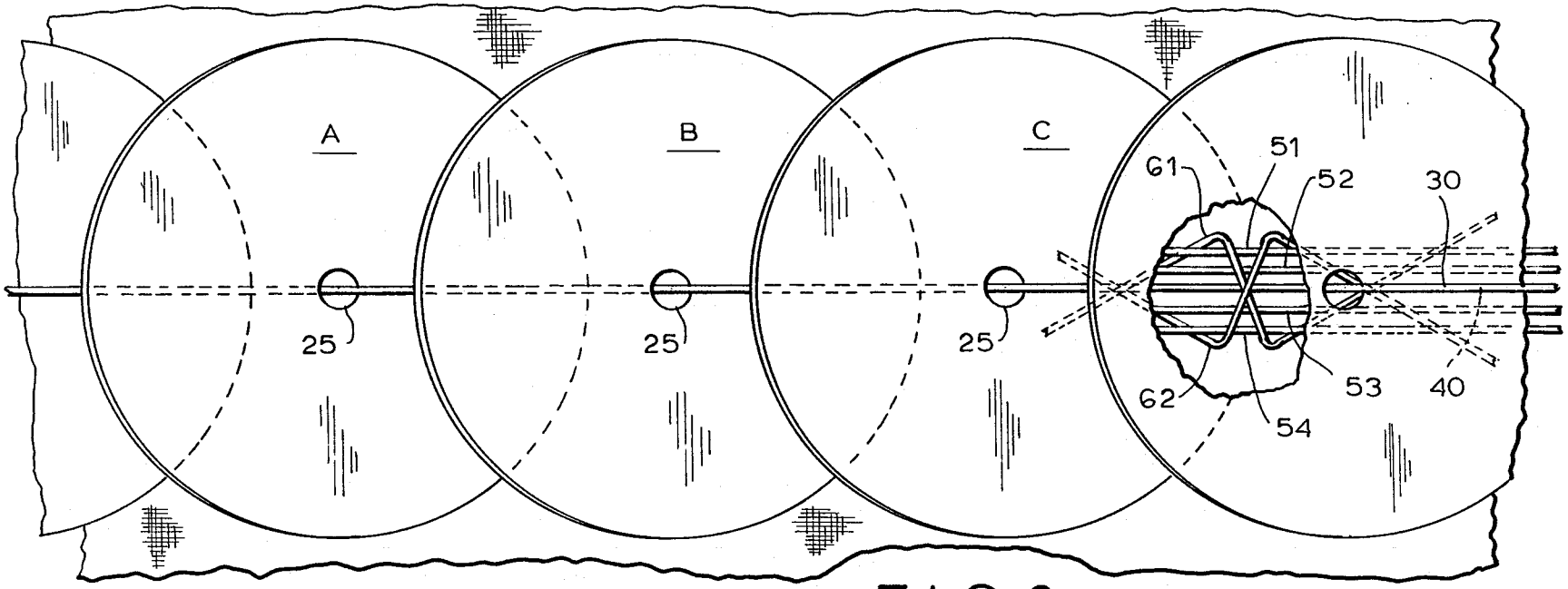
FIG. 1 is a front view, on an enlarged scale, of a section of fabric embodying the present invention.
Figure 2:
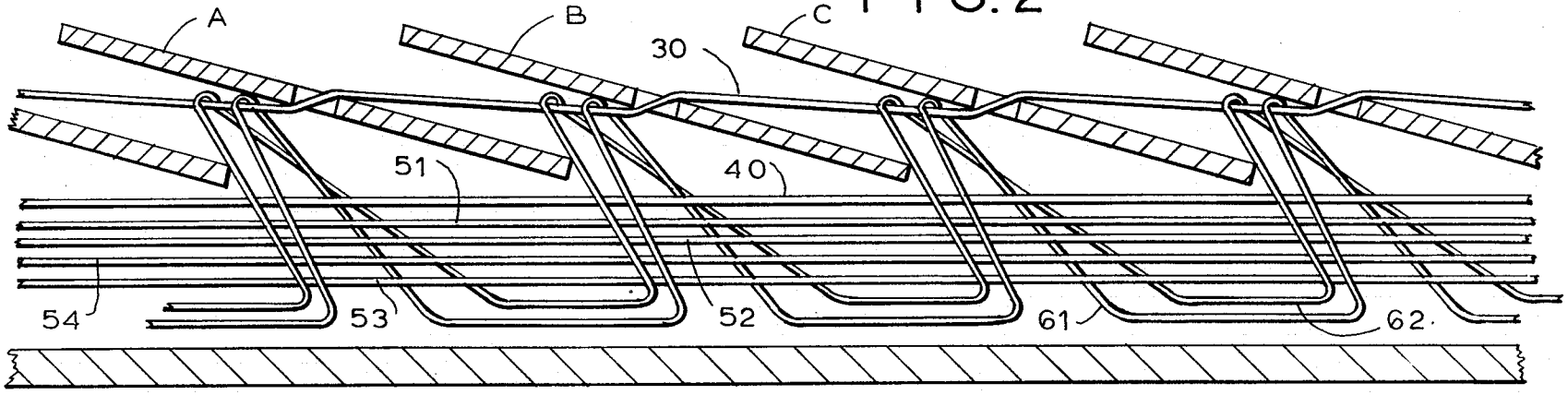
FIG. 2 is a cross-sectional view of the present invention affixed to a fabric showing the structure of threads used to hold the ornaments together and to the fabric.

Reference is now made to FIG. 2 which shows a cross-sectional view of the adornment 10 attached to a fabric 20. The fabric is preferably cloth which can be selected from a wide range of materials as well as synthetic materials. For reasons which will become obvious the cloth may also be made from paper or other porous materials.

The series of individual sequins A, B, C, D, E lie face up on the cloth. The sequins are shown to be overlapping so that the edge 20 of sequin B touches the eye 25 of sequin A. Alternate embodiments are foreseen in which the adjacent sequins either touch edge to edge, overlap slightly, or are spaced at either periodic or non-periodic intervals. The exact positioning of adjacent sequins is a matter of preference.

A main thread 30 runs through the eyes of each ornament. The main thread, like the other threads mentioned below, may be formed from either natural or synthetic material. A filler thread 40 and four heat-softenable threads 51, 52, 53, 54 run essentially parallel to the main thread along the underside of the ornaments. In the preferred embodiment, two bobbin threads 61 and 62 entwine the main thread, filler thread, and heat-softenable threads and serve to bind them in close proximity to each other and hold them along the underside of the ornaments. Alternate embodiments utilize heat-sealable threads as the bobbin thread, with or without filler thread/s or the main thread either alone or in combination with each other or in combination with heat-softenable threads as shown.

The ornament 10 is affixed to the fabric by placing it so the underside contacts the fabric. Heat and pressure are then applied to cause the heat-softening threads 51, 52, 53 and 54 to melt and intermingle with the filler thread and the fabric. As a result the filler thread becomes integral with the fabric and the adornment is thus affixed to the fabric.

The heat and pressure may be applied in any of the conventional methods known to the art. In a preferred embodiment the fabric and adornment are run through the nip of a pair of rollers. The lower roller is heated and applies sufficient heat and pressure to affix the adornment to the fabric as described above. Alternately the upper roller or both the upper and lower rollers are heated to melt the heat-softenable threads. An adhesive tape may be used to ensure the adornment remains properly positioned during handling. After heating the tape may simply be peeled off the fabric.

Figure 3:
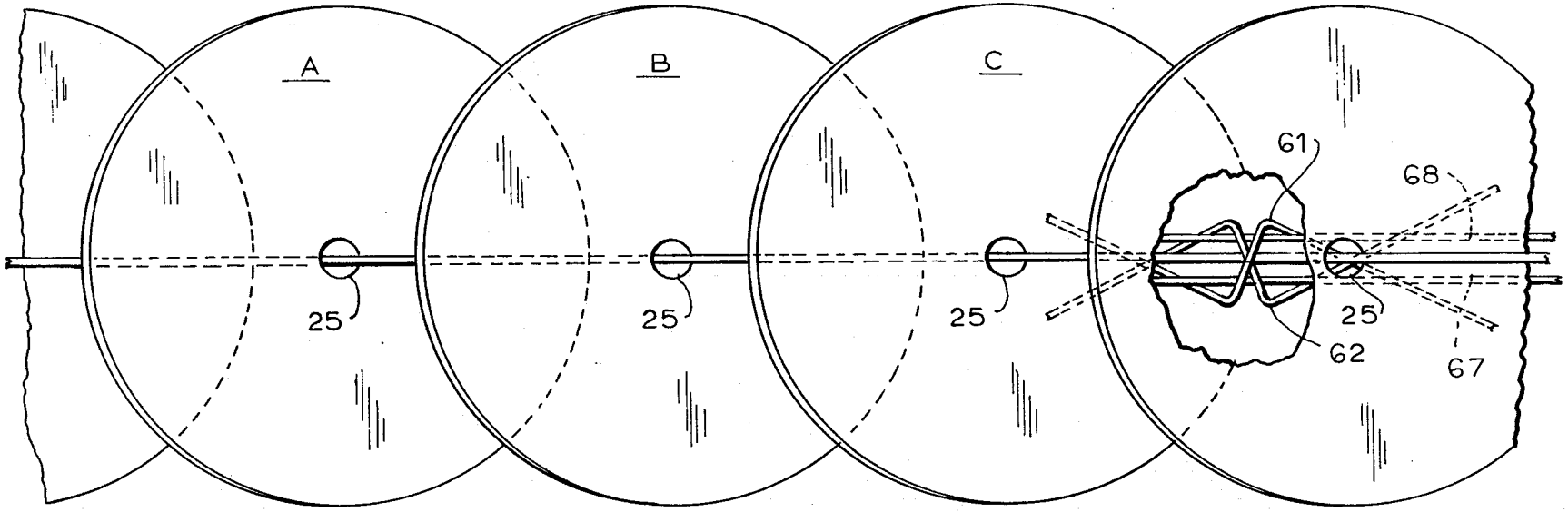
FIG. 3 is a front view, on an enlarged scale, of an alternate embodiment of the invention.
Figure 4:
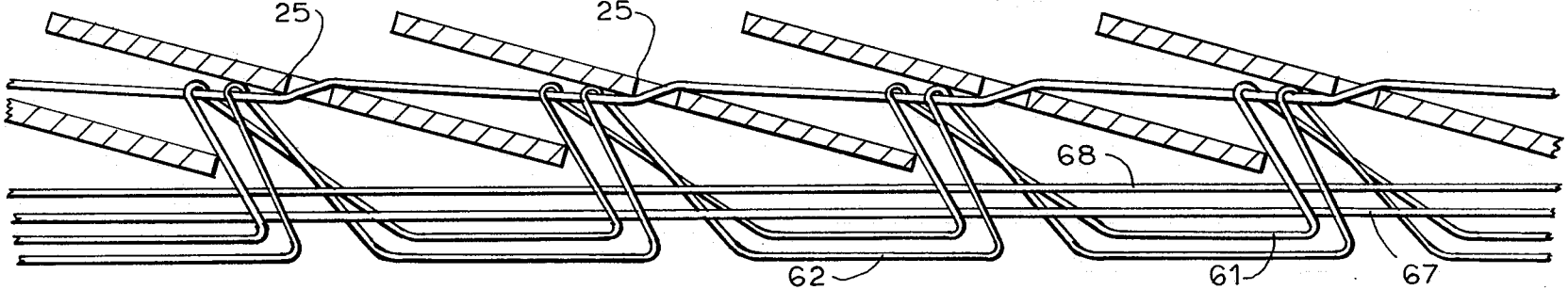
FIG. 4 is a cross-sectional view an alternate embodiment of the invention.

In an alternate embodiment of the invention shown in FIGS. 3 and 4 the two bobbin threads 61 and 62 entwine a main thread 30 and two flexible wires 67 and 68. The flexible wire provides a decorative effect and allows for positioning the series of ornaments which form the adornment in a given pattern so that the adornment can be affixed to the fabric without constant attention to its shape. The bobbin threads and/or the main threads may be softenable and serve to bind the adornment to the cloth. Sequins with wire can also be used as a separate unit on their own to give shape to artificial flowers, hair, fur, or feather trimmings, decorative ties, bows, etc.

Figure 5:
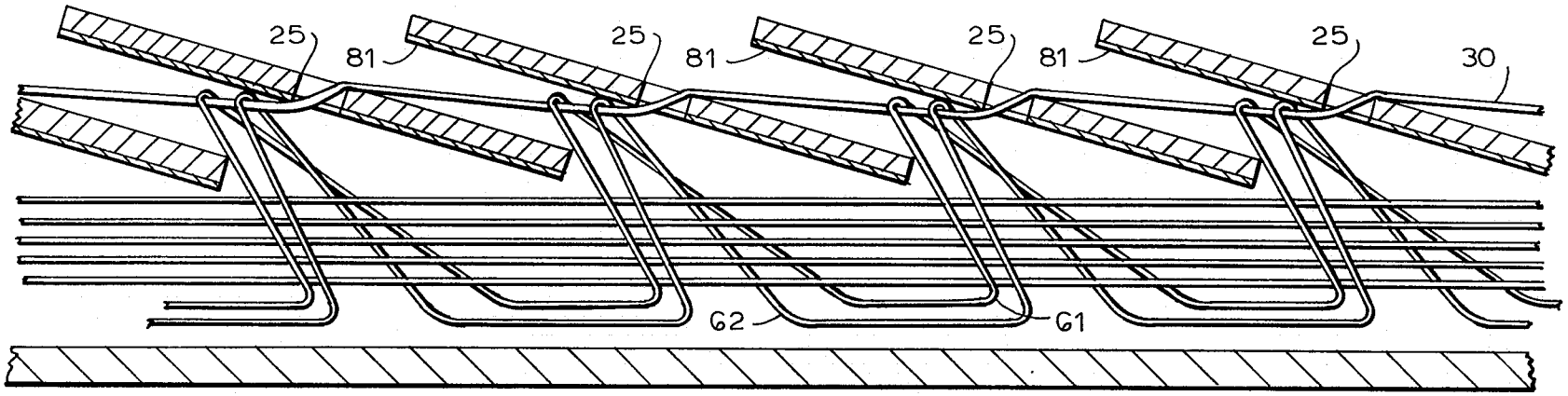
FIG. 5 is a cross-sectional view of a third embodiment of the invention.

A third embodiment of the invention is seen in FIG. 5. This embodiment does not have heat sealable threads but rather a coating 81 on the sequins of a heat softenable material. The ornaments of the embodiment are attached by threads and/or wires and affixed to fabric as described above.

While the invention has been particularly shown and described with reference to preferred embodiments thereof, it will be understood by those skilled in the art that variations in form may be made without departing from the spirit and scope of the invention.

What is claimed is:

1. An adornment for affixing the same to a surface, said adornment comprising a plurality of ornaments and at least one heat sealable thread means operatively engaging a plurality of such ornaments for affixing the same to a surface, said heat sealable thread means comprises fusible bonding thread which upon the application of heat becomes adhesive at a temperature less than the melting temperature at which the adornment is destroyed, and second thread means maintaing said ornaments in a predetermined relationship with respect to each other prior to affixing the same to a surface.

2. The adornment of claim 1 wherein said heat sealable thread means is a binder thread.

3. The adornment of claim 1 wherein said heat sealable thread means is a filler thread bound to the underside of said ornaments.

4. The adornment of claim 1 wherein said heat sealable thread means comprises at least one binder thread and at least one filler thread bound to the underside of said ornaments.

5. The adornment of claim 1 wherein said heat sealable thread means is a main thread which is in engagement with said ornaments.

6. The adornment of claim 1 wherein said heat sealable thread means comprises at least one binder thread, at least one filler thread bound to the underside of said ornaments and a main thread which is in engagement with said ornaments.

7. An adornment for affixing the same to a surface, said adornment comprising:

a plurality of ornaments arranged in series having top side and an underside;

a main thread means;

at least one filler thread bound to the underside of said series of ornaments by at least one binder thread;

at least one heat sealable thread in close proximity to said filler thread and bound to the underside of said series of ornaments by said binder thread; and said heat sealable thread comprises fusible bonding thread which upon application of heat becomes adhesive at a temperature less than the melting temperature at which the adornment is destroyed and thereby is operative in affixing said ornaments to a surface, and said main thread means in association with said binder thread to maintain said ornaments in a predetermined relationship with respect to each other prior to affixing the same to a surface.

8. The ornament of claim 7 wherein said ornaments are sequins.

9. The ornament of claim 8 wherein said sequins are lying edge to edge.

10. The adornment of claim 8 wherein said sequins are at spaced intervals.

11. The adornment of claim 8 wherein said sequins are either lying at spaced intervals to each other or edge to edge.

12. The adornment of claim 8 wherein said sequins are overlying so that the edge of a first sequin lies on the top side of an adjacent sequin.

13. The adornment of claim 7 wherein said ornaments are beads.

14. The adornment of claim 7 wherein the number of said binder threads is two.

15. The adornment of claim 7 wherein said heat sealable thread comprises said filler thread.

16. The adornment of claim 7 wherein said heat sealable thread comprises said binder thread.

17. The adornment of claim 7 wherein said filler threads is made of flexible metal wire.

18. The adornment of claim 7 wherein at least one of said filler threads is heat sealable and at least one of said filler threads is wire.

19. The adornment of claim 7 wherein the number of said heat sealable threads is from one to ten.

20. The adornment of claim 7 wherein said filler thread means is a wire.

21. The adornment of claim 7 wherein said main thread means is a wire.

22. The adornment of claim 7 wherein said binder thread is a wire.

23. An adornment comprising:

a plurality of ornaments arranged in a series having a top side and an underside;

a main thread;

a flexible wire thread bound to the underside of said series of ornament by at least one binder thread and being shaped and in association with the main thread to maintain the plurality of ornaments in a desired predetermined configuration.

24. The adornment of claim 23 wherein said ornaments are sequins.

25. The adornment of claim 24 wherein said binder thread is heat sealable.

26. An adornment comprising:

a plurality of ornaments, at least one flexible wire, thread means connecting said ornaments and maintaining said ornaments in an overlapping relationship with respect to each other, and said wire being coupled to said thread means and said ornaments for maintaining said adornment in a desired predetermined configuration.

* * * * *

UNITED STATES PATENT AND TRADEMARK OFFICE

CERTIFICATE OF CORRECTION

PATENT NO. : 4,952,436

DATED : August 28, 1990

INVENTOR(S) : Roberta Ruschmann

It is certified that error appears in the above-identified patent and that said Letters Patent is hereby corrected as shown below:

Claim 1. Column 3, line 23, change "maintaing" to --maintaining--.

Signed and Sealed this

Twenty-ninth Day of October, 1991

*Attest:*

HARRY F. MANBECK, JR.

*Attesting Officer*

*Commissioner of Patents and Trademarks*